United States Patent [19]

Swarovski

[11] Patent Number: 4,842,904

[45] Date of Patent: Jun. 27, 1989

[54] CHANDELIER PENDANT

[75] Inventor: Daniel Swarovski, Wattens, Austria

[73] Assignee: D. Swarovski & Co., Wattens, Austria

[21] Appl. No.: 915,991

[22] Filed: Oct. 3, 1986

[30] Foreign Application Priority Data

Oct. 11, 1985 [DE] Fed. Rep. of Germany ..... 3536367

[51] Int. Cl.[4] ..... F21V 5/06; B44F 1/00; A47G 35/00

[52] U.S. Cl. ..... 428/28; 428/542.2

[58] Field of Search ..... 362/337, 339; 428/28, 428/428, 7, 542.2

[56] References Cited

U.S. PATENT DOCUMENTS

| | | | |
|---|---|---|---|
| 976,681 | 11/1910 | Mygatt | 362/337 |
| 1,092,114 | 3/1914 | Mygatt | 362/337 |
| 1,477,523 | 12/1923 | Ruttenberg | 428/28 |
| 1,477,524 | 12/1923 | Ruttenberg | 428/28 |
| 3,506,534 | 4/1970 | Yinan | 428/28 X |

FOREIGN PATENT DOCUMENTS

| | | | |
|---|---|---|---|
| 813981 | 9/1951 | Fed. Rep. of Germany . | |
| 1153332 | 8/1963 | Fed. Rep. of Germany . | |
| 1880708 | 8/1963 | Fed. Rep. of Germany . | |
| 1955719 | 5/1971 | Fed. Rep. of Germany . | |
| 0013198 | 3/1987 | Japan | 428/28 |

*Primary Examiner*—Nancy A. B. Swisher
*Attorney, Agent, or Firm*—Bacon & Thomas

[57] ABSTRACT

A chandelier pendant consisting of a carrier element which is flat at least on one side, a plurality of decorative-elements being cemented in an ornamental arrangement to its flat surface.

2 Claims, 1 Drawing Sheet

CHANDELIER PENDANT

The present invention relates to a chandelier pendant.

In the case of chandelier pendants, it is desirable for them to be available with the greatest variety of shapes and richness of faceting.

However, it is difficult to manufacture a richly faceted chandelier pendant and in particular those arrangements in which facet elements are staggered cannot be polished mechanically..

The invention is based on the problem of providing a chandelier pendant characterized by a manifold design and rich faceting although it is easy to manufacture.

The invention is based on the finding that this can be achieved if the chandelier pendant is composed of a plurality of single parts.

The object of the invention is a chandelier pendant having at least one faceted surface which is characterized in that the faceted surface is formed by the upper side of a plurality of decorative elements arranged in a row whose flat underside is cemented to a flat surface of a carrier element which is flat at least on one side.

The inventive chandelier pendants are characterized by being easy to manufacture. They can be manufactured in a great variety of shapes with a large number of facets.

The carrier element preferably has on each side a flat surface with decorative elements cemented thereto. The decorative elements themselves have a flat underside and a faceted upper side.

The invention shall be explained in more detail in the following with reference to the drawing, which shows exemplary embodiments.

BRIEF DESCRIPTION OF DRAWING

FIG. 1 shows a chandelier pendant 1, an attractively designed carrier element 2 being shown from the front which is suspended on the chandelier through suspension means such as hole 7. The carrier element has on each side a flat surface 3, 3'. Decorative elements 4 are cemented in an ornamental arrangement to one flat surface 3.

It goes without saying that the design and arrangement of decorative elements 4 can be varied within extremely wide limits.

Figure 1:
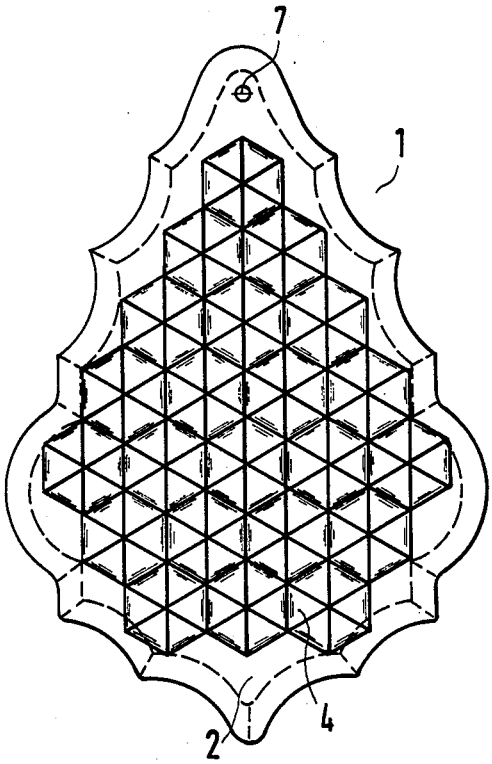
FIG. 1 a plan view of a chandelier pendant.
Figure 2:
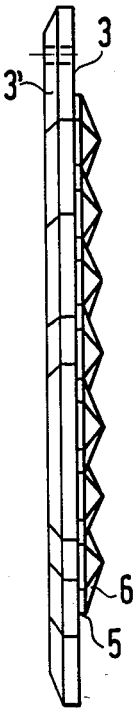
FIG. 2 a side view of the chandelier pendant as in FIG. 1.

As can be seen in FIG. 2, no decorative elements 4 are provided on the other flat surface 3'. However, it is possible to provide decorative elements on both sides.

The individual decorative elements 4 are in staggered arrrangement adjacent to and abutting one another. Such a design could not be manufactured by conventional mechanical grinding and polishing.

Carrier element 2 and decorative elements 4 are preferably made of glass. Suitable colorless adhesives are known for cementing.

Underside of the decorative elements is also flat so that it can be cemented to flat surface 3 of carrier element 2, while upper side 6 has a pyramid shaped as shown in FIG. 2 faceted design.

I claim:

1. A chandelier pendant having a plurality of faceted surfaces comprising a carrier element having at least one flat surface and suspension means for suspending said element on a chandelier, a plurality of pyramid shaped decorative elements each of which includes a faceted upperside and a flat underside, wherein said flat underside of said decorative elements are cemented to said flat surface of said carrier element adjacent and abutting one another in an ornamental staggered arrangement.

2. A chandelier pendant according to claim 1 in which each side of said carrier element defines a flat surface.

* * * * *